United States Patent [19]

Rendl

[11] 4,346,633

[45] Aug. 31, 1982

[54] SPARK PLUG WRENCH ADAPTED FOR ADJUSTABLE TORQUE

[76] Inventor: René Rendl, Lukas-Cranach-Str. 4, D-6710 Frankenthal, Fed. Rep. of Germany

[21] Appl. No.: 198,720

[22] Filed: Oct. 20, 1980

[30] Foreign Application Priority Data

Nov. 2, 1979 [DE] Fed. Rep. of Germany ..... 2944182

[51] Int. Cl.[3] ..... B25B 23/14

[52] U.S. Cl. ..... 81/475; 464/43

[58] Field of Search ..... 81/473–476; 64/29, 30 R

[56] References Cited

U.S. PATENT DOCUMENTS 2,471,614 5/1949 Gilman ..... 64/30 R 3,960,039 6/1976 Nash et al. ..... 81/475

FOREIGN PATENT DOCUMENTS 342481 10/1921 Fed. Rep. of Germany ..... 81/475

8000845 12/1979 Netherlands ..... 81/475

*Primary Examiner*—James L. Jones, Jr.

*Attorney, Agent, or Firm*—Kinzer, Plyer, Dorn & McEachran

[57] ABSTRACT

The invention is concerned with a spark plug wrench with provision for adjustment of the torque, the wrench comprising two toothed discs (2, 3) supported within and at one end of a cylindrical housing (1), these discs being provided at their confronting faces with teeth (5) of a form such that, when screwing-out takes place sharply dependent flanks of opposed teeth are applied together to transmit the full force while, when screwing-in takes place, slippage is allowed between the teeth. In one embodiment the inner lying toothed disc (3) is arranged on an axially displaceable attachment spindle (6) and held against rotation. At the opposite end of the housing (1) is a threaded disc (10) with an adjusting ring (11), and the last-mentioned toothed disc (3) is axially displaceable and has a pack of spring washers (16) thereon to produce the required pressure between the discs (2, 3) for transmitting a pre-set torque.

5 Claims, 5 Drawing Figures

SPARK PLUG WRENCH ADAPTED FOR ADJUSTABLE TORQUE

Figure 1:
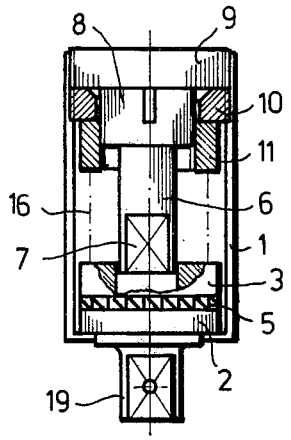

This invention relates to a spark plug wrench adapted for adjustable torque, comprising a cylindrical housing, two toothed discs disposed in said housing, spring means urging said discs against one another, said discs having sets of teeth at their confronting faces and each of said teeth having at one side a sharply depending flank and, at the other side, a shallow depending flank, a first connection means on one of said discs for engagement with an operating tool, and a second connection means on the other of said discs for operation by means to vary torque applied by said wrench.

A construction of this nature is known and in this one toothed disc is secured to a spindle the outer end of which projects from the housing which is defined by a bush and a nut. A plurality of spring washers are arranged between this toothed disc and the nut and these serve to urge the aforesaid toothed disc against teeth located therebelow on the end of the cylindrical bush. The spindle projecting from the housing is provided with a polygonal section. This known wrench is suited for variation of the wrench torque a slip being provoked when the preset torque of the wrench is reached, whilst during opening or screwing out of the spark plug the full effort can be applied.

A substantial defect of this known construction lies however in the fact that the spindle referred to, when the preset torque is reached, is subject to an up and down movement depending on the tooth height, and to obtain more convenient handling of the wrench the user has to press on the spindle, which means that the torque is actually falsified by the pressure application. This defect in the use of the wrench manifests itself in the fact that, shocks depending on the number of teeth are produced. A further disadvantage occurring in the known construction is that special adaptors have to be used to apply an extension piece. As a result of ageing or tiring of the springs, wear and the like the preset torque is slightly altered and the further and important disadvantage is met that there is no means to apply a later adjustment to the torque.

It is an object of the present invention to provide a wrench of this nature which is adapted for appropriate modification of the torque with an avoidance of the disadvantages set forth above and which can be used with the tools and connection pieces which are to be found in most present day factories or workshops, and without need for an adaptor.

In an advantageous embodiment of the invention a universal joint is connected to the aforesaid spindle.

As a further advantageous feature, for supporting the connection spindle in the housing this spindle is provided with a threaded collar and associated with this is a loose threaded disc, the threaded disc can be coupled and fixed to the collar by means of setscrews and an adjusting ring with counter threading can be screwed up on the threaded disc on the spindle to support the springs.

In a further feature the threaded disc is provided with an annular surface bevelled towards the threaded collar.

It is further proposed that the spindle be rotatably held on the threaded disc and an adjusting bush, whilst the other toothed disc shall be held against rotation in the housing.

In this connection it is of advantage to have pins laterally on the threaded disc which engage in slots in the adjusting bush.

In this latter embodiment moreover the spindle is equipped with a cylindrical part with a contact collar and a conical surface which serves as supports for the adjusting bush and the threaded disc.

Further it is proposed for the spindle and the second disc to be provided with connection parts for levers, extensions and the like.

The invention brings the substantial advantage of dispensing with the use of a special adaptor because the upper end of the spindle may be provided with a four-, six-, -eight sided polygon or the like for direct connection of the extension. This caters for reduced constructional height and the wrench altogether caters for better handling. A further substantial advantage resides in the fact that the preset torque is reached and the two toothed discs turn and slip one relatively to the other, and no jumping occurs on the spindle, which simplifies its use and does not falsify the torque. A further great advantage resides in the fact that a wrench of this character is greatly simplified because it is only necessary to use toothed discs of a particularly high grade steel, whilst the remaining parts of the structure do not call for such high quality material. A further substantial advantage of the invention resides in the fact that a torque can be adjusted very simply whilst the small space which is required for this purpose for the application of these parts is utilised in optimum fashion.

The invention is illustrated by embodiments thereof in the accompanying drawings, which will be described.

Figure 2:
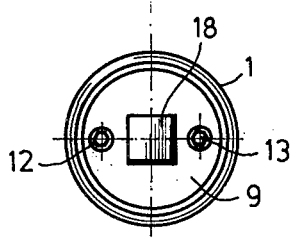
Figure 3:
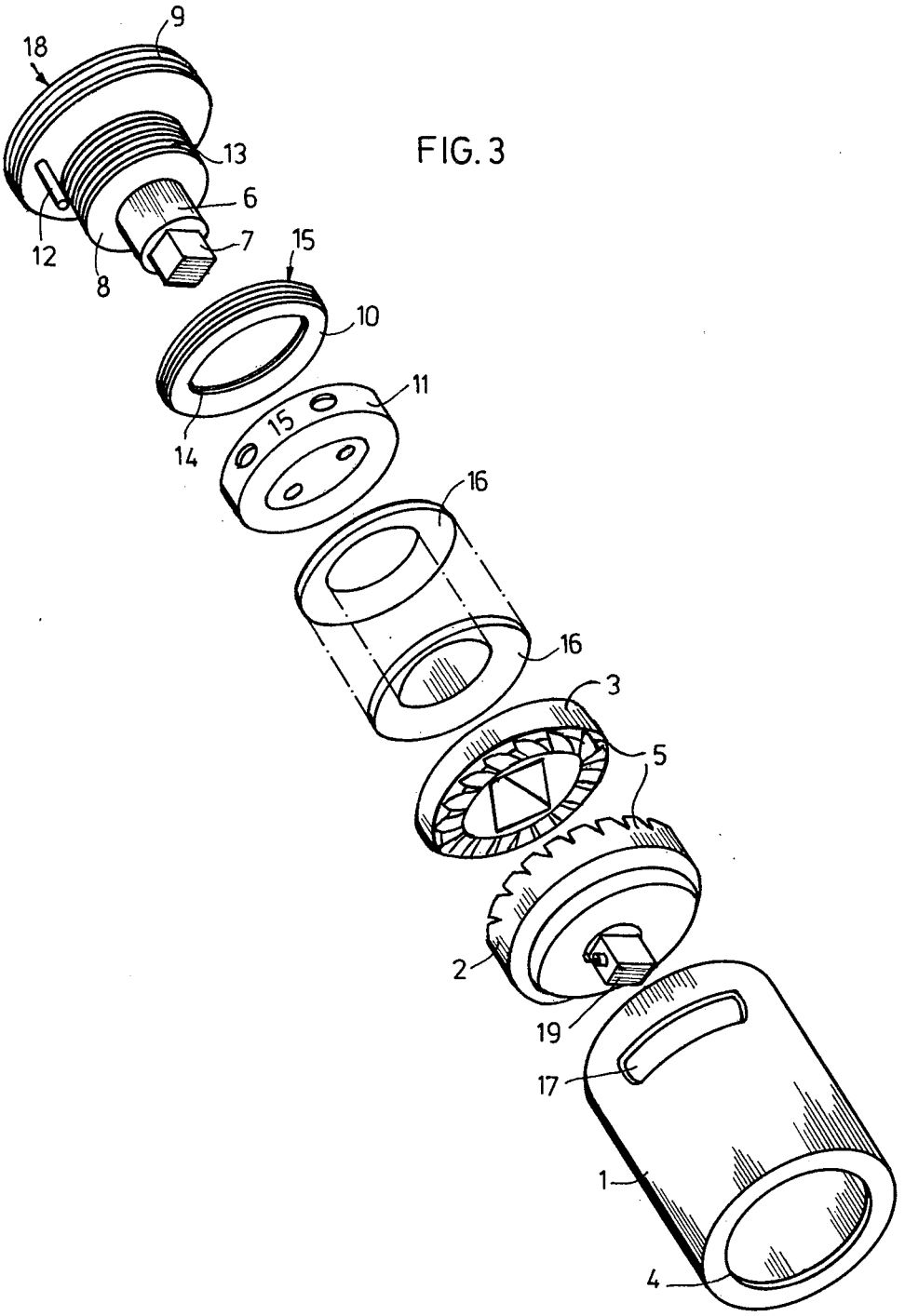
Figure 4:
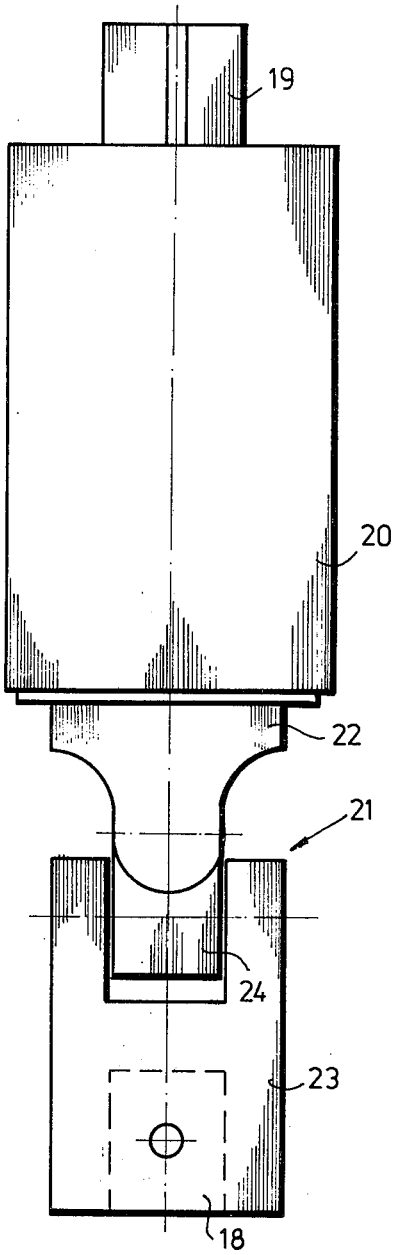
Figure 5:
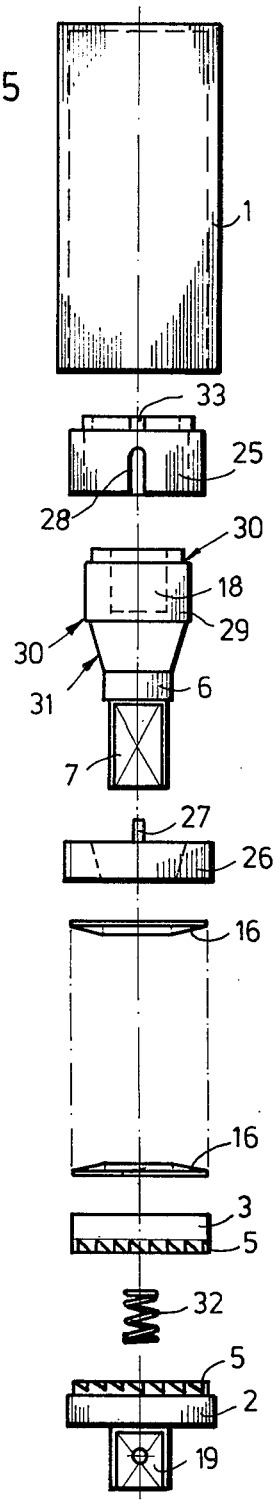

In these drawings:

FIG. 1 is a longitudinal section through a first embodiment of a wrench of this nature, FIG. 2 is a plan view corresponding to FIG. 1, FIG. 3 is an exploded representation of this wrench, FIG. 4 illustrates a further embodiment of the wrench and FIG. 5 is a final embodiment of the wrench shown with the individual parts exploded.

In the embodiment of the invention illustrated in FIGS. 1 and 3 the individual elements of the spark plug wrench are arranged in a cylindrical housing 1. Important components of the wrench are two toothed discs 2, 3, and of these the toothed disc 2 is supported against a collar 4 of the housing. The discs 2, 3 are provided at their confronting faces with teeth 5 which, as viewed in one direction of turning of the wrench, have flanks of shallow declination and, as viewed in the opposite direction, have sharp flanks. The effect then is that, in turning in one rotational direction, for example when the spark plug is screwed out, the sharp flanks can take the full turning effort whilst, when screwing in there is slippage between the discs 2, 3.

Toothed disc 3 is arranged on an attachment spindle 6 of special construction (see below) and is axially displaceable and held against rotation. In the embodiment illustrated there is a part of a quadrilateral section fulfilling the latter function, and in addition the spindle 6 has a threaded part 8 of small diameter and a second and larger diameter threaded part 9 by means of which the spindle 6 can be screwed into the housing 1. A thin threaded disc 10 can be slid over the threaded part 8, with the threading of the disc 10 bearing loosely against the threading of the collar 9. An adjusting ring 11 is screwed up on the threaded part 8 from below, the threading of part 8 being contrary to the threading of the collar 9. Small axially-directed, tapped holes are made in the collar 9 and headless pins 12, 13 can be screwed into these holes to cooperate with the threaded disc 10 and act as set screwes. One pin 12 has the function of holding the ring 10 against rotation, an appropriate lateral slot being provided for this purpose in ring 10. The second pin 13 bears against an inclined surface 15 on the ring 10 and thereby presses the ring laterally outwards into the flanks of the thread of housing 1, all this then locking the spindle 6.

A pack of spring washers 16 is arranged between the adjusting ring 11 and the axially displaceable toothed disc 3, these washers catering for the pressure between the two discs 2, 3 necessary for transferring the adjusted torque.

The torque is adjusted by means of the adjusting ring 11, appropriate markings being provided on this ring and being visible through a window 17 in housing 1. To set the required torque the adjusting ring 11 is screwed up on the threaded part 8 and locked by means of the pin 12 acting as a set screw. The complete spindle 6 is then screwed into the housing 1 with the other parts and locked in the required position with the assistance of the further set screw 13. To effect subsequent adjustment the two screws 12, 13 are released, the adjusting ring 11 slightly regulated and the two set screws 12, 13 then fixed again.

For the attachment of levers, extensions, spanner parts and the like the threaded spindle 6 is provided externally, that is to say in the area of the collar 9, with an inner polygonal recess 18 whilst the toothed disc 2 is provided with an external polygonal part 19.

For compactness in use it is necessary in many cases for the assembled wrench 20 to be provided with a universal joint 21 (FIG. 4), the appropriate holder 22 being provided directly on the spindle 6. The coupling with an adaptor piece 23 is effected using a connector 24. This kind of assembly provides for a higher torque transfer.

FIG. 5 shows a further embodiment of a spark plug wrench of this kind, in which the arrangement of the two toothed discs 2, 3 is similar to that used in the embodiments previously described. The outer toothed disc 2 is provided with threading and is screwed into and locked against rotation in the housing 1. The spindle 6 is rotatably mounted in the opposed part of the housing 1 between an adjuster bush 25 and a threaded disc 26 which are held against rotation relatively to one another. For this purpose there are lateral pins 27 on the threaded disc 26 and these engage in appropriate slots 28 in the adjuster bush 25. Further the spindle 6 has a cylindrical part 29 with a bearing collar 30 by which the spindle 6 is held axially between the two parts 25 and 26. In addition the spindle 6 has a conical surface 31 cooperating with a surface of corresponding conicity in the disc 26. There is also a small spiral spring 32 between the two discs 2, 3 which simplifies assembly of the wrench.

A wrench attachment surface 33 is provided on the adjuster bush 25 by means of which the coupled part 25, 26 can be turned and the torque increased or reduced thereby.

I claim:

1. A spark plug wrench comprising a cylindrical housing, two toothed discs disposed in said housing, spring means urging said discs against one another, said discs having sets of teeth at their confronting faces and each of said teeth having at one side a sharply depending flank and, at the other side, a shallow depending flank, a first connection means on one of said discs for engagement with an operating tool, and a second connection means on the other of said discs for operation by means to vary torque applied by said wrench, characterized by: a connection spindle (6) carried at one end of said housing and holding one of said toothed discs (3) against rotation but adapted for axial displacement relatively to the latter, said housing being equipped with an inturned collar (4) for abutment with the other of said toothed discs (2), said spindle (6) being provided with an externally-threaded collar (9) supported against the internal wall of said housing (1), a loose externally-threaded ring (10) associated with said threaded collar (9) and the latter being equipped with setscrews (12,13) for coupling and fixing said loose ring (10) to said collar (9), a torque-adjusting ring (11) disposed on a boss (8) of said spindle, said boss having external threading of opposite hand to internal threading on said loose ring (10), and a pack of spring washers between said torque-adjusting ring (11) and the inner of said toothed discs (3).

2. A spark plug wrench according to claim 1, characterised by the fact that said loose ring (10) is formed internally with an annular surface (15) which tapers towards said collar (9).

3. A spark plug wrench according to claim 1, characterised by the fact that it comprises a threaded disc (26) and an adjusting bush (25) rotatable on said spindle, and said other toothed disc (2) being non-rotatably mounted on said housing (1).

4. A spark plug wrench according to claim 3, characterised by the fact that pins (27) are secured laterally to said threaded disc (26) and engage in slots (28) in said bush (25).

5. A spark plug wrench according to claim 4, characterised by the fact that said spindle (6) has an enlarged cylindrical section (18) providing at one end a support surface (30) for said bush (25), and adjoining this section (18) a tapered section (31) providing an abutment for the tapered interior of said threaded disc (26).

* * * * *